US005641921A

United States Patent [19]

Dennis et al.

[11] Patent Number: 5,641,921

[45] Date of Patent: Jun. 24, 1997

[54] LOW TEMPERATURE, LOW PRESSURE, DUCTILE, BONDED CERMET FOR ENHANCED ABRASION AND EROSION PERFORMANCE

[75] Inventors: Mahlon Denton Dennis; Barton Hampshire, both of Houston, Tex.

[73] Assignee: Dennis Tool Company, Houston, Tex.

[21] Appl. No.: 517,814

[22] Filed: Aug. 22, 1995

[51] Int. Cl.[6] ..... C22C 29/00; B22F 7/00

[52] U.S. Cl. ..... 75/230; 75/236; 75/244; 75/245; 75/248; 419/8; 419/12; 419/13; 419/14; 419/48; 419/57; 148/206; 51/309

[58] Field of Search ..... 75/245, 243, 236, 75/244, 247, 248, 235, 230; 419/12–14, 48, 57.8; 51/309; 148/206

[56] References Cited

U.S. PATENT DOCUMENTS

| | | | |
|---|---|---|---|
| Re. 32,036 | 11/1985 | Dennis | 175/329 |
| 3,136,615 | 6/1964 | Bovenkerk et al. . | |
| 3,233,988 | 2/1966 | Wentorf, Jr. et al. . | |
| 3,609,818 | 10/1971 | Wentorf, Jr. . | |
| 3,745,623 | 7/1973 | Wentorf, Jr. et al. | 29/95 B |
| 4,255,165 | 3/1981 | Dennis et al. | 51/309 |
| 4,604,106 | 8/1986 | Hall et al. | 51/293 |
| 4,647,546 | 3/1987 | Hall, Jr. et al. | 501/96 |
| 4,662,896 | 5/1987 | Dennis | 51/293 |
| 4,784,023 | 11/1988 | Dennis | 76/108 A |
| 5,011,514 | 4/1991 | Cho et al. | 51/295 |
| 5,011,515 | 4/1991 | Frushour | 51/307 |
| 5,096,465 | 3/1992 | Chen et al. | 51/295 |
| 5,116,568 | 5/1992 | Sung et al. | 419/11 |
| 5,211,726 | 5/1993 | Slutz et al. | 51/293 |

*Primary Examiner*—Ngoclan Mai

[57] ABSTRACT

This invention is directed toward a material which is used to coat or create a surface for machine cutting tools, all types of drill bit teeth, saw teeth, bearing surfaces valve seats, nozzles and the like, thereby producing surfaces which are highly abrasion and erosion resistant. Furthermore, this invention includes some of the possible methods for producing such a material given that the methods and apparatus required provide a significant cost reduction over those required for producing prior art surface materials with similar abrasion and erosion resistant properties. More specifically, the material set forth can be formed at relatively low temperatures and relatively low pressures by sintering mixtures for a relatively short period of time.

23 Claims, 3 Drawing Sheets

FIG. 4
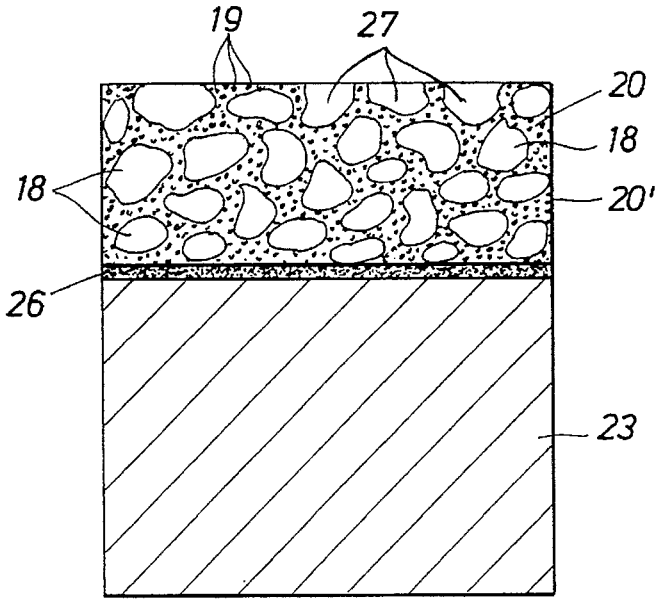
FIG. 6
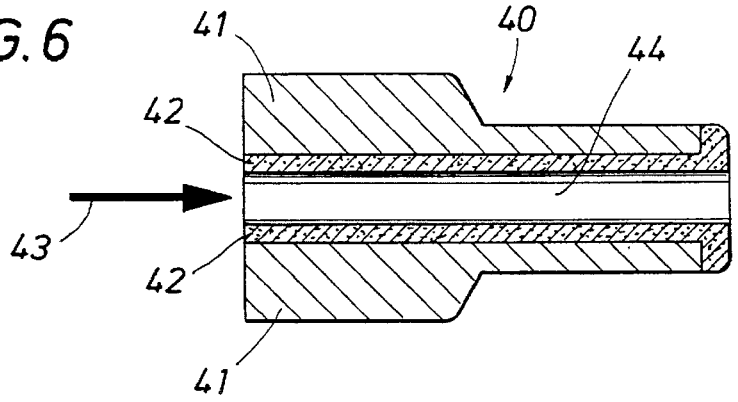
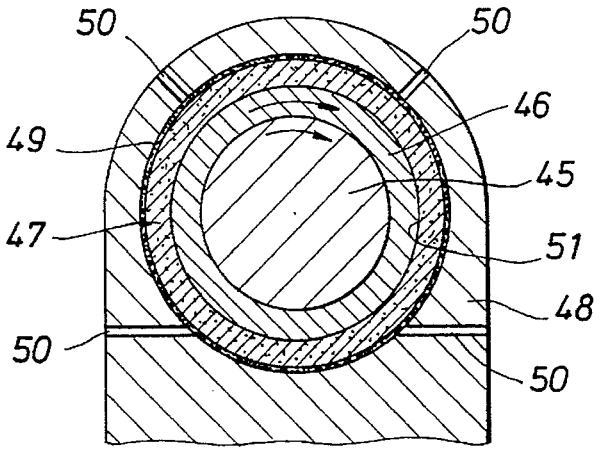
FIG. 7

LOW TEMPERATURE, LOW PRESSURE, DUCTILE, BONDED CERMET FOR ENHANCED ABRASION AND EROSION PERFORMANCE

FIELD OF THE INVENTION

This invention is directed toward a material which is used to coat or create a surface for machine cutting tools, all types of drill bit teeth, saw teeth, bearing surfaces, valve seats, nozzles and the like, thereby producing surfaces which are highly abrasion and erosion resistant. Furthermore, this invention includes some of the possible methods for producing such a material given that the methods and apparatus required provide a significant cost reduction over those required for producing prior art surface materials with similar abrasion and erosion resistant properties.

BACKGROUND OF THE INVENTION

It is well known to use diamonds to form hard, abrasion resistant and erosion resistant coatings or surfaces on cutting tools, bearings, drill bits, nozzles, valve seats and the like. There are several types of surfacing and supporting assemblies which utilize diamond as a constituent. In one type, the diamonds are a very small size and randomly distributed in a supporting matrix. Another type includes diamonds of a larger size positioned on the surface of a supporting member in a predetermined pattern. Still another type involves the use of a surface formed of a polycrystalline diamond supported on a sintered carbide or other type of support member (PDC). This support member may be, as an example, a cutting tool structure, or a drill bit structure.

Diamonds are an allotropic form of carbon, which is crystallized isometrically. It consists of carbon atoms covalently bound by single bonds only in a predominantly octahedral structure. This accounts for its extreme hardness (Mohs 10) and great stability. It has a specific gravity of 1.5 and a coefficient of friction of 0.05. Diamonds will melt at 3700 degrees centigrade (°C). They can also be made synthetically by heating carbon and a metal catalyst in an electric furnace at about 3000° F. under pressure of about 1.0 million pounds per square inch (psi).

Carbide is a binary solid compound of carbon and another element. The most familiar carbides are those of calcium, tungsten, boron, and iron (cementite). Two factors have an important bearing on the properties of carbides: (1) the difference in electronegativity between carbon and the second element, and (2) whether or not the second element is a transition metal. A "cemented carbide" is formed from a powdered form of refractory carbide which is united by compression with a bonding material (usually iron, nickel, or cobalt), followed by sintering. For example, tungsten carbide is bonded with 3 to 25 percent cobalt at 1400° C. Cemented carbide is used chiefly in metal cutting tools, which are hard enough to permit cutting speeds in rock or metal up to 100 times that obtained with alloy steel tools.

Boron nitride (BN) occurs as a white powder, with a particle size of about 1 micron, having a graphite-like hexagonal plate structure which melts at 3000° C. When compressed at a million psi, it becomes as half as hard as diamond. The resulting material has excellent heat-shock resistance.

It should be understood that the term polycrystalline diamond (PCD) or polycrystalline diamond compact (PDC) or sintered diamond, as the material is often referred to in the literature, can also be any of the super hard materials, including, but not limited to synthetic or natural diamond, cubic boron nitride (CBN), and wurtzite boron nitride as well as combinations thereof. Also, cemented metal carbide refers to a carbide of one of the group IVB, VB, or VIB metals which is pressed and sintered in the presence of a binder of cobalt, nickel, or iron and the alloys thereof.

As discussed in U.S. Pat. No. 4,255,165, a cluster compact is defined as a cluster of abrasive particles bonded together either (1) in a self-bonded relationship, (2) by means of a bonding medium disposed between the crystals, or (3) by means of some combination of (1) and (2). Reference can be made to U.S. Pat. Nos. 3,136,615; 3,233,988 and 3,609,818 for a detailed disclosure of certain types of compacts and methods for making such compacts. All of these teachings specify the use of high temperature combined with high pressure for a relatively long period of time to form the various compacts.

A composite compact is defined as a cluster compact bonded to a substrate material such as cemented tungsten carbide. A bond to the substrate can be formed either during or subsequent to the formation of the cluster compact. It is, however, again highly preferable to form the bond at high temperatures and high pressures, and for a time period comparable to those at which the cluster compact is formed. Reference can be made to U.S. Pat. No. 3,745,623 for a detailed disclosure of certain types of composite compacts and methods for making same. The composite compact is then attached to a support structure such as the metallic body or shank of a cutting tool.

As discussed in U.S. Pat. No. 5,011,515, composite polycrystalline diamond compacts, PDC, have been used for industrial applications including rock drilling and metal machining for many years. As an example, the composite compact consisting of PDC and sintered substrate are affixed as insert elements in a rock drill bit structure. One of the factors limiting the success of PCD is the strength of the bond between the polycrystalline diamond layer and a sintered metal carbide substrate. It is taught that both the PDC and the supporting sintered metal support substrate must be exposed to high pressure and high temperature, for a relatively long period of time, in order to achieve the desired hardness of the PDC surface and the desired strength in the bond between the PDC and the support substrate.

U.S. Pat. No. 3,745,623 (reissue U.S. Pat. No. 32,380) teaches the attachment of diamond to tungsten carbide support material with an abrupt transition there between. This, however, results in a cutting tool with a relatively low impact resistance. Due to the differences in the thermal expansion of diamond in the PCD layer and the binder metal used to cement the metal carbide substrate, there exists a shear stress in excess of 200,000 psi between these two layers. The force exerted by this stress must be overcome by the extremely thin layer of cobalt which is the common or preferred binding medium that holds the PDC layer to the metal carbide substrate. Because of the very high stress between the two layers which have a flat and relatively narrow transition zone, it is relatively easy for the compact to delaminate in this area upon impact. Additionally, it has been known that delamination can also occur on heating or other disturbances in addition to impact. In fact, parts have delaminated without any known provocation, most probably as a result of a defect within the interface or body of the PDC which initiates a crack and results in catastrophic failure.

One solution to the PDC-substrate binding problem is proposed in the teaching of U.S. Pat. No. 4,604,106. This patent utilizes one or more transitional layers incorporating powdered mixtures with various percentages of diamond, tungsten carbide, and cobalt to distribute the stress caused by the difference in thermal expansion over a larger area. A problem with this solution is that "sweep-through" of the metallic catalyst sintering agent is impeded by the free cobalt and the cobalt cemented carbide in the mixture. In addition, as in previous referenced methods and apparatus, high temperatures and high pressures are required for a relatively long time period in order to obtain the assembly disclosed in U.S. Pat. No. 4,604,106. Pressures and temperatures are such that, using mixtures specified, the adjacent diamond crystals are bonded together.

U.S. Pat. No. 4,784,023 teaches the grooving of polycrystalline diamond substrates but it does not teach the use of patterned substrates designed to uniformly reduce the stress between the polycrystalline diamond layer and the substrate support layer. In fact, this patent specifically mentions the use of undercut (or dovetail) portions of substrate ridges, which solution actually contributes to increased localized stress. Instead of reducing the stress between the polycrystalline diamond layer and the metallic substrate, this actually makes the situation much worse. This is because the larger volume of metal at the top of the ridge will expand and contract during temperature cycles to a greater extent than the polycrystalline diamond, causing the composite to fracture at the interface. As a result, construction of a polycrystalline diamond cutter following the teachings provided by U.S. Pat. No. 4,784,023 is not suitable for cutting applications where repeated high impact forces are encountered, such as in percussive drilling, nor in applications where extreme thermal shock is a consideration.

By design, all of the cutting surfaces disclosed in the above references are "hard" in that they are abrasion and erosion resistant. This is particularly true for PDC material which is also quite brittle and subject to fracturing upon impact. Because of the brittleness and overall hardness, it is not practical and economical to mold or machine surfaces of tools, bearings and the like made of PDC in the manufacturing process for these devices. Alternately, the PDC surfaces are preferably "molded" or preformed using techniques taught in U.S. Pat. No. 4,662,896.

In summary, prior art teaches the manufacture and the use of various abrasion and erosion resistant materials to form inserts which are used as wear surfaces for machine tools, drill bits, bearings, and other similar surfaces. All of the processes in the cited references require high temperatures and high pressures for a relatively long period of time to form the wear resistant surface material, or to bond the wear resistant surface material to the underlying support substrate, or both. Furthermore, the bond between surface and substrate of the resulting inserts is subject to weakening due to differences in thermal expansion properties which become a factor as the device heats up during use. These surfaces are formed under high pressure, temperature, and application time to form a surface which is quite hard and durable, but which is also quite brittle, subject to fracturing upon impact, and are in general very difficult to handle in the manufacturing process of tools employing such wear resistant surfaces. High temperature and high pressure equipment used in the manufacture of devices employing PDC are quite expensive to obtain and to maintain.

SUMMARY OF THE INVENTION

The present invention is directed toward eliminating, or at least minimizing, many problem areas in the design and manufacture of surfaced machine cutting tools, drill bit teeth, bearings, valve seats, and the like set forth in the above discussion of the prior art.

The invention includes a wear surface material which is made from a mixture of abrasion resistant, hard, or super hard materials such as diamond crystals, and/or cubic boron nitride (CBN), mixed with a metal or a metal alloy containing a metal which is reactive with the abrasion resistant material. Examples of such reactive metal include, but are not limited to, titanium (Ti) or zirconium (Zr). These metals would form titanium carbide (TiC) or zirconium carbide (ZrC) in the given examples. Some of these carbides would be formed on the surface of the abrasion resistant material and would create a more stable and stronger interface between the metal and the abrasion resistant material. The content of diamond crystals, by volume, is approximately 60% or greater. The actual wear surface material is formed by sintering the mixture at a relatively low temperature for a short period of time under a relatively low pressure which varies depending upon the embodiment as will be discussed subsequently. Means for heating the mixture of abrasion resistant crystals and metal can be a simple torch, an induction oven, a source of infrared light, a laser source, a plasma, or even a resistive heating oven. High temperature and high pressures are not required for extended periods of time as in the prior art surface manufacturing techniques discussed previously. The elimination of high temperature and high pressure manufacturing facilities greatly reduces the final cost of the wear resistant surface material, although a comparable product could be produced using high temperature and high pressure for a shorter period of time than is required to produce PDC using the compositions described herein.

The resulting wear resistant surface material created by sintering the mixture of abrasion resistant crystals, preferably diamond crystals, and the metal, which partially transforms to the metallic carbide, is a cemented diamond compact containing 60% or more diamond by volume, but lacking the diamond to diamond bonding found in the surfaces discussed in the prior art. Due to the high metal content and the short time of sintering, not all of the metal is reacted with the abrasion resistant material. The metal which is not reacted is then free to form a matrix in which the abrasion resistant material is suspended. This metal matrix is responsible for the enhanced ductility and fracture toughness of the material. The end result is a material with comparable abrasion and erosion properties to conventional, prior art materials, but the cermet of the current invention is less costly to produce, has better impact resistance, and is more easily formed.

The wear surface produced by the current invention will be referred to as a "cermet" which is defined as a sintered mixture of crystalline material, metal, and/or metallic carbides. The cermet wear surface can be either cast as a wear surface insert or, alternately can be cast, sintered, and directly fused to a support structure such as a cutting tool, drill bit, or similar structure requiring an abrasion and erosion resistant surface. It is also possible that this material would be applicable using methods similar to conventional hard facing materials. Examples of these methods include direct welding with a torch, laser, TIG, MIG, and plasma spraying.

Turning first to the casting embodiment, the abrasion resistant crystal and metal mixture is placed into a cast or mold, which is preferably the exact shape of the cermet wear resistant surface insert desired. The mixture and mold are placed in an environment of inert or reducing gas and then heated for a relatively short period of time at a relatively low temperature thereby sintering the mix into a molded cermet insert. Production of the cermet by this method does not require any applied pressure, although the application of pressure may shorten the time required to sinter the cermet. Upon completion of the sintering process, the molded cermet insert is then removed and preferably brazed to the wear surface of a supporting member such as a metallic or cemented tungsten carbide cutting tool.

Attention is next turned to the sintering of the wear resistant surface directly upon a substrate or support member which can, as an example, again be a metallic or cemented tungsten carbide cutting tool. The mixture of metal and abrasion resistant crystals, preferably, but not limited to cubic boron nitride or diamond, is now placed within a pressure tight mold such that the mixture is positioned at the location of the desired cermet wear surface. The mold is designed such that external pressure and heat can be applied simultaneously for a relatively short period of time to the mixture. The sintering process is similar to the processes described in the wear surface insert casting process described above. After sintering, the support member now contains a cermet wear surface directly bonded thereto. The bond between the metal matrix and the supporting member, steel or cemented tungsten carbide for examples, is very resilient, fracture resistant, and thermally matched when the assembly is heated during usage such as cutting, drilling, machining and the like.

The reactive metal used in the wear resistant material is preferably titanium (Ti), zirconium (Zr), vanadium (V), or chromium (Cr). However, other reactive metals may be used including, but not limited to, tantalum (Ta), molybdenum (Mo), niobium (Nb), or tungsten (W). The thermal match between a cermet using titanium (Ti) as a matrix metal and cemented tungsten carbide (WC) as a supporting substrate machine tool has been found to be especially good. Furthermore, cermets using Zr as a matrix material, or alternately matrices utilizing Ta, Cr, Mo, V and W also form acceptable bonds with supporting substrate machine tools made from cemented WC. The embodiment of the invention using other metals and other cermets will be discussed in subsequent sections of this disclosure. Also, noble metal additions such as gold, silver, palladium, or platinum may be made to enhance wetting to the given support member and modify thermal expansion.

To briefly summarize, the wear resistant cermet is not as hard as previously described PDC surfaces, but is much more ductile, fracture resistant, and usually better thermally matched to the underlying support member. The cermet material is much less expensive to produce than PDC wear surfaces because it is not necessary to sinter the components at very high temperatures and very high pressures for an extended time period. This reduces the cost of the manufacturing equipment. In addition, the amount of costly abrasive crystals within the mixture is minimized. The cermet, when formed directly on the support structure, yields a wear resistant surface which exhibits the excellent bonding characteristics described above. Stated another way, although not as hard as PDC, the cermet of the present invention should last much longer in actual use for some applications as a wear resistant surface due to its better fracture resistance, ductility, resilience, and longer lasting bonding characteristics with the supporting assembly.

Applications of the invention are numerous. Abrasion resistant and ductility characteristics of the cermets render them ideal for uses as wear resistant surfaces of machine tools, cutting tools, drill bits, saws, bearing races and the like. Erosion resistant characteristics of the cermet render them ideal for use as valve seats and nozzles for flowing liquids. Other uses and applications of the invention will become apparent in the following detailed description of preferred embodiments of the invention.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

FIG. 4 shows conceptually the internal structure of a cermet and the supporting structure after processing;

FIG. 6 illustrates a cross sectional view of a nozzle which utilizes a cermet material as an erosion resistant surface; and;

FIG. 7 shows a view of a bearing, rotating shaft and support structure in which a cermet material is used on a wear prone surface.

DETAILED DESCRIPTION OF THE PREFERRED EMBODIMENTS

As mentioned previously, the cermet wear resistant surface can be embodied both as a formed insert which is subsequently attached to a supporting structure such as a tool, or can be embodied as a wear resistant surface manufactured directly upon, and bonded thereto, a supporting structure such as a tool. There are other embodiments of the invention as will become apparent to those skilled in the art, including direct application to a surface without the use of molds. The preferred embodiments of cast inserts and direct bonded inserts will be discussed separately.

CAST CERMET INSERTS

Figure 1:
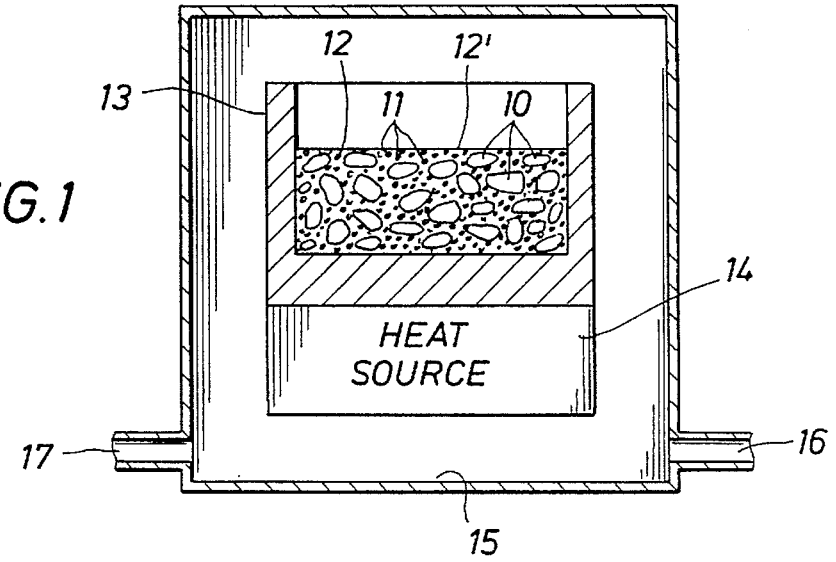
FIG. 1 depicts an apparatus used to cast cermet wear resistant surface inserts for subsequent mounting onto a support structure and the mix of materials within the mold prior to heating.

Attention is now directed toward FIG. 1 which illustrates the apparatus required to form formed cermet wear resistant surfaces. A mixture 12' of abrasive crystals identified by the numerals 10 and 11 and a metal 12 is placed within a mold 13 which represents the shape of the cermet insert upon completion of the manufacturing process. Abrasive crystals may or may not differ in size and/or composition. The purposes of varying the size and composition are known to those skilled in the art. One reason to vary size may be to increase the packing efficiency of the abrasion resistant crystals, thereby increasing the effective abrasion resistance of the material for a given volume. For purposes of illustration, the abrasive crystals are depicted as a larger size 10 and a smaller size 11 in FIG. 1. It should be understood that the abrasive resistive crystals can also differ in composition as represented conceptually by the differing numerical designations 10 and 11. The metal component 12 of the mix 12' can be in a variety of physical forms such as foil, slithers, powder, or combinations thereof. For purposes of illustration, it will be assumed that the metal matrix component 12 of the mix 12' is in the form of a powder. A heat source 14 is attached, placed in contact, or otherwise positioned with respect to the mold 13 so that heat can be transferred to the mix 12' within the mold 13. The heat source can be a simple torch, an induction oven, a source of infrared light, a laser source, a resistive heating oven, or even an exothermic chemical reaction. The mold 13 is enclosed within a controlled environmental chamber 15. It should, however, be restated that the heat source does not have to be physically attached to the mold as stated above. Furthermore, the heat source 14 can be outside of the controlled environmental chamber 15 if heat can be effectively transferred through the chamber 15 to the mold 13 and eventually to the mixture 12'. Prior to heating, the controlled environmental chamber 15 is purged of oxygen by vacuum, or by flowing an inert or reducing gas into the chamber by means of inlet 15 and exhausting any oxygen present within the chamber 15 through the exhaust outlet 17.

Still referring to FIG. 1, heat is next applied to the mixture 12' by means of the heat source 14 such that the temperature of the mixture 12' is raised to at least the liquidus temperature and preferably at least 50° C. over the liquidus temperature of the metal matrix material 12 for a period of time sufficient to allow the mixture 12' to react and densify. This period of time is preferably less than about 5 minutes. During this heating process, the reactive part of the metal matrix 12 reacts with the surface of the abrasion resistant crystals 10 and 11 to form a compound which is more easily wetted by the metal matrix 12. More specifically, if titanium (Ti) is used as the reactive part of the metal matrix 12 and diamond is used for abrasion resistant crystals 11 and 12, the titanium will react to form titanium carbide (TIC). The titanium carbide formed on the surface of the diamond crystals forms a strong metallurgical bond with the metal matrix. Alternately, if zirconium (Zr) were the reactive part of the metal matrix material 12 and cubic boron nitride (CBN) were the abrasion crystals 10 and 11, there would be a layer of zirconium boride (ZrB) and zirconium nitride (ZrN) formed on the surface of the CBN which would allow strong bonding of the abrasion crystals 10 and 11 to the metal matrix 12.

Figure 2:
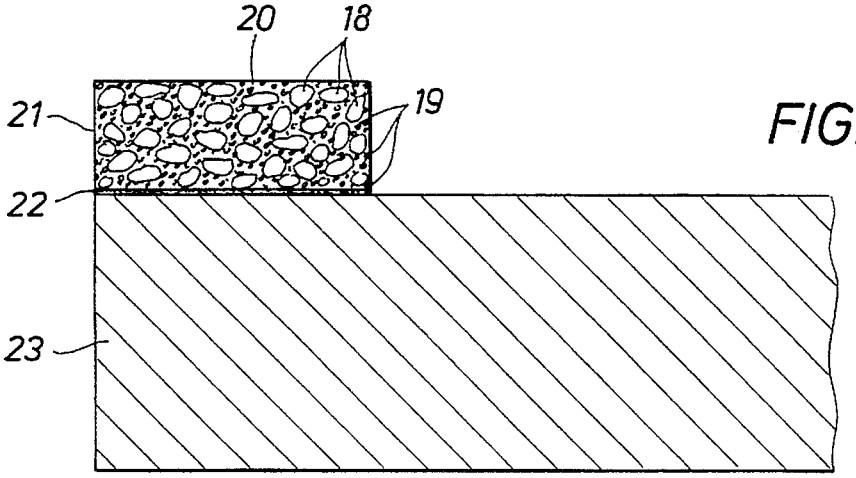
FIG. 2 illustrates conceptually the internal structure of a formed wear resistant surface insert after being heated, removed from the casting mold, and brazed to a support structure.

Attention is now directed to FIG. 2 which shows a cast insert 21 composed of abrasion resistant crystals 18 and 19 which are coated with reaction products in a metal matrix 20 formed by the previously described sintering process. This insert 21 is shown affixed to a supporting member 23, such as a machine or cutting tool, insert holder by means of a braze joint 22. The abrasion resistant crystals at the top or outer surface of the structure 21 will resist wear of the supporting member 23 to which structure 21 is attached. It should be noted that there is no diamond to diamond bonding in the material denoted as a whole by the numeral 21 which is different from the diamond to diamond bonding found in prior art PDC materials.

DIRECT BONDED CERMET WEAR RESISTANT SURFACES

Figure 3:
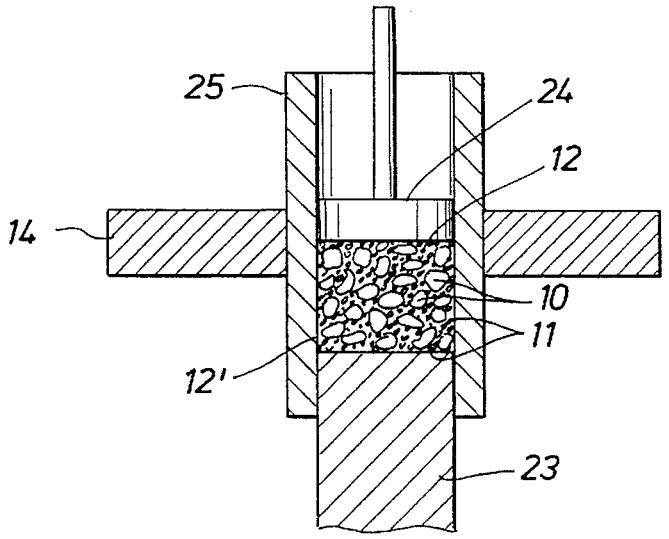
FIG. 3 depicts an apparatus used to form a cermet wear resistant surface directly on a support structure and the mix of materials within a mold prior to heating under applied pressure.

Wear resistant surfaces can be sintered directly upon a metal support structure such as a drill bit tooth, cutting tool, machine cutting tool, or the like. Attention is directed to FIG. 3 which conceptually depicts the preferred apparatus used in affixing cermet wear resistant material directly to a support structure 23. The portion of the support structure 23 to which the wear surface is placed in a mold 25. A ram 24 is used to exert slight pressure to the mixture 12' of abrasive crystals again denoted by the numerals 10 and 11 and metal 12. A heat source 14 is attached, placed in contact, or otherwise positioned with respect to the mold 25 so that heat can be transferred to the mix 12' within the mold 25. Again, the heat source can be of varying types as described previously. Pressures and temperatures used to sinter the mix 12' are much lower that those used in forming PDC wear resistant materials. As an example, the mixture 12' depicted in FIG. 3 is typically heated to a temperature of less than 1100° C. at a pressure of about 1000 psi for a period of less than 1 minute. Upon completion of the sintering process, a wear resistant surface is directly bonded to the supporting structure 23.

FIG. 4 depicts a coating 20' on a supporting member 23. In the wear resistant coating 20' are abrasion resistant crystals 18 and 19 bonded with reaction products in a metal matrix 20. Also depicted are some of the wear resistant crystals 18 and 19, identified specifically with the numeral 27, and which form a surface layer of the coating 20' thereby serving as an abrading surface to protect the remaining portion of the coating 20' from being eroded. The bonding region 26 of the wear resistant coating material 20' to the supporting material 23 has been exaggerated in thickness, but it is included for the sake of being thorough. This region 26 is similar or identical to the interface in FIG. 2 between the filler metal 20 and any of the parts 21 joined in a braze joint 22. This bond region 26, given the fact that the matrix 20 of the wear resistant coating 20' is metal, gives the wear resistant material 20' an increased fracture toughness, resiliency, and thermal expansion match with the supporting member 23. Matching the thermal expansion coefficients is effective as a means of reducing stresses which occur when using milling, cutting, drilling, and grinding tools due to the heat generated due to friction. These thermally induced stresses increase the likelihood of catastrophic failure of PDC coated tools during use due to delaminating of the PDC from its supporting member, or failure due to fracture near the region of bonding between the PDC and the supporting member. However, the matching of thermal coefficients of expansion of the wear resistant coating material 20' to that of the supporting member 23 in the present invention renders this stress less significant. In addition, the bonding layer 26 may contain a stress attenuation material of high toughness and intermediate thermal expansion to alter the residual stress state. Noble metal additions can also help in reducing residual stresses.

After the material in the present invention has been formed, the surface of the material may be further processed either to enhance its properties or to protect the layer during subsequent processing prior to use. Examples of possible further processing include, but are not limited to, nitriding or carburizing via ion bombardment and application of a film, such as diamond or titanium nitride, via chemical vapor deposition (CVD).

EXAMPLES

The following examples are of the materials and methods used in the manufacture of two exemplary cermet materials.

Example 1

A mix of diamond powders having grain sizes of approximately 100 and 25 microns is places in a thin refractory metal cup. A metal binding phase containing mostly zirconium powder with some trace additions of other metals to enhance the properties of the binding phase is placed in the cup. The ratio of diamond to metal powders is approximately 60:40 percent by volume. The mix of diamond and metal powders is then placed into an argon atmosphere and heated to 1,100° C. for about 1 minute under normal atmospheric pressure. Removing the cup yields the cast insert described previously.

Example 2

A mix of diamond powders having grain sizes of approximately 400, 100, and 25 microns is placed in a thin refractory metal cup. A metal binding phase consisting of approximately 70% titanium, 15% copper, and 15% of material in the form of metal powders is also placed in the same container. This assembly is then heated to about 1,000° C. over the course of about 40 seconds in a reducing atmosphere of nitrogen and hydrogen. The assembly is then allowed to cool in air to room temperature. When the cup is removed from the assembly, the abrasion resistant material described in this disclosure will then be bonded to the substrate as previously described.

ABRASION AND EROSION PERFORMANCE

Four cermet samples along with a cemented tungsten carbide and a PDC sample were produced in the form of cylinders and subjected to an erosion simulation to determine the relative and absolute erosion resistant properties. The erosion tests consisted of placing the samples under a small weight on a rotating plate for a given period of time, where the rotating plate was covered with a slurry mixture containing diamond crystals. This process is frequently referred to as lapping and is used in many applications to erode and/or polish surfaces. The cermet samples labeled A and B contain mixtures of fine diamond of size less than 150 micrometers (μm), and samples labeled C and D contain a mixture of coarser diamond (<600 μm). The metal matrix of all four samples was the same. The differences between samples A and B, and samples C and D, were in processing after sintering.

Figure 5:
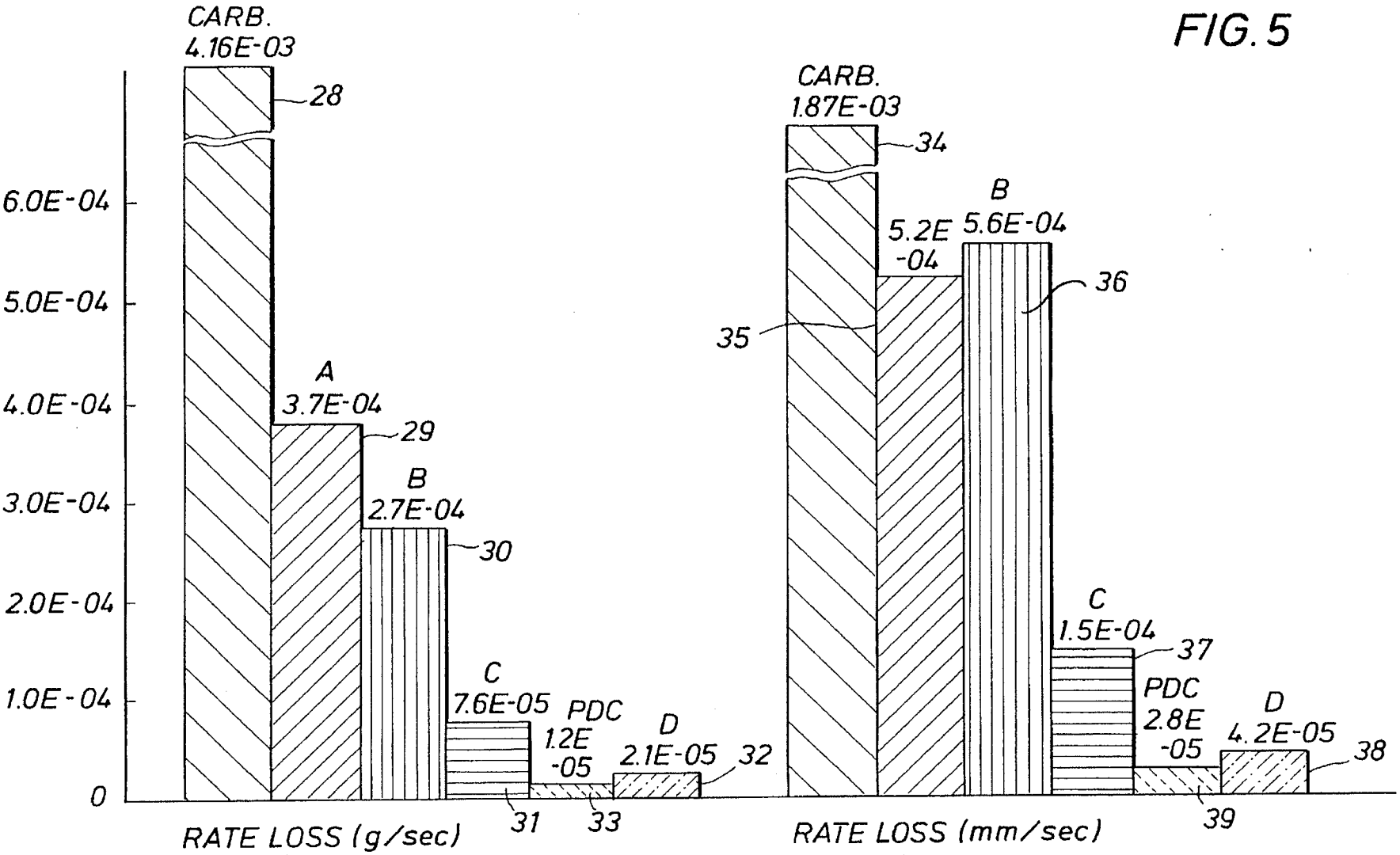
FIG. 5 shows a comparison of erosion tests of four types of cermet, carbide, and PDC wear surface materials.

Results of the erosion tests are summarized in FIG. 5 in the form of bar graphs. Erosion test results are first shown by the rate of sample mass loss in units of grams per second (g/sec). Carbide, represented by the bar 28, was the most susceptible to erosion with a loss rate of $4.16\times10^{-3}$ g/sec. The samples A, B, and C represented by the bars 29, 30, and 31, respectively, exhibited losses of $3.7\times10^{-4}$, $2.7\times10^{-4}$ and $7.6\times10^{-5}$ g/sec, respectively. Sample D, represented by the bar 32, exhibited a loss of $2.1\times10^{-5}$ g/sec compared with PDC, represented by the bar 33, which exhibited a loss of $1.2\times10^{-5}$ g/sec. All cermet samples exhibit significantly better erosion resistance than carbide. It is apparent that cermet sample D approaches the erosion resistance of PDC while being more ductile, resilient, and fracture resistant, and much less costly to produce.

Erosion tests were also made wherein the rate of sample loss in millimeters per second (mm/sec) was measured. Carbide, represented by the bar 34, exhibited a loss of $1.87\times10^{-3}$ mm/sec. Samples A, B and C represented by bars 35, 36, and 37, respectively, exhibited losses of $5.2\times10^{-4}$, $5.6\times10^{-4}$, and $1.5\times10^{-4}$ mm/sec, respectively. Sample D, represented by the bar 38, exhibited a loss of only $4.2\times10^{-5}$ mm/sec which is very close to the loss of PDC of $2.8\times10^{-5}$ mm/sec, represented by the bar 39. All cermet samples exhibit an order of magnitude or greater erosion resistance than carbide. Again, the erosion resistant properties of sample D approach that of PDC and are orders of magnitude more erosion resistant than carbide.

Abrasion test results have not fully been completed. However, the relationship between erosion and abrasion is very close, with the major difference in the tests being that erosion is usually due to small particles rubbing across the surface of the sample, and abrasion is due to rubbing the surface of the sample with a larger piece of material. Initial tests have confirmed this relationship, with the materials having a coating of the materials of the present invention exhibiting abrasion resistance falling somewhere between carbide and PDC.

APPLICATIONS

The disclosed cermet materials have many applications. One such application can be defined generally as wear resistant surface coatings for machine tools which include drill bits, cutters, saw teeth, mills, grinders, drill bit teeth, and the like. The hard, yet resilient, fracture resistant, and well bonded surfaces yielded by the current invention form wear surfaces which are not as hard as PDC, but which will last significantly longer in some applications than prior art PDC wear resistant surfaces.

The cermets, possessing excellent erosion resistant properties, also provide an excellent surface over which to flow various fluids. Cermets can be used as valve seats, nozzle inserts, and the like. FIG. 6 illustrates the cermet material in a nozzle which is denoted as a whole by the numeral 40. The support structure body 41 contains a cylindrical insert 42 made of cermet material which is preferably cast and inserted within the support structure body 41. The insert can be press fitted or alternately brazed to the body 41. Fluid flows through the nozzle in a direction indicated by the arrow 43 and, upon entering the nozzle 40, flows through the cylindrical orifice 44 within the cermet insert 42. The fluid flow, therefore, abrades the cermet insert rather than the nozzle body 41. If, as an example, the fluid consists of a mixture of liquid and sharp particulate sand, the fluid could quickly erode the nozzle support structure 41 in the absence of the cermet insert 42. The wear insert 42 does, however, provide the desired erosion protection for the nozzle.

Cermet material also can be used in bearings. FIG. 7 illustrates a cross section of such a bearing, shaft and support body. The shaft 45 is coated with a wear resistant surface 46 such as PDC. The bearing "race" is a ring 47 of cermet material which is preferably cast as an insert and preferably attached to a bearing support structure 48 by braze 49. The conduits 50 are used as ports into which the brazing material is flowed. Alternately, the cermet insert 47 can be press fitted into the bearing support structure 48. In this embodiment, the cermet race, which is slightly more subject to wear at the interface 51 as previously discussed, will be the first component of the bearing to fail and to require replacement. If more practical, the bearing structure can be alternately constructed such that the race 47 is made of the more wear resistant material such as PDC and the ring 46 can be formed from preferably cast cermet material. Again, the resilient, fracture resistant properties of the cermet material results in a bearing structure which lasts longer than a bearings in which PDC surfaces are in contact at the interface 51. This is because the cermet material and PDC can be thermally matched to their support structures should the shaft 45 and bearing support 48 be made of materials which exhibit different thermal expansion coefficients, and where one expansion coefficient is substantially different from that of PDC. In this situation, if PDC were used on both surfaces, the PDC on the support surface with the differing thermal expansion coefficient will rapidly fracture as the bearing heats when placed into operation.

Although preferred embodiments of the invention have been specifically described and illustrated herein, it is to be understood that variations may be made without departing from the spirit and scope of the invention, as defined in the appended claims.

What is claimed is:

1. A method for making wear resistant material comprising:

(a) providing abrasion resistant particles;

(b) providing solid matrix material which is reactive with said abrasion resistant particles;

(c) placing a mixture of said abrasion resistant particles and said solid matrix material within a neutral or reducing environment purged of oxygen; and (d) sintering said mixture of said abrasion resistant particles and said solid matrix material within said neutral or reducing environment at a sintering temperature at least equal to the liquidus temperature of said solid matrix material and at applied pressure less than about 1,000 psi, thereby forming a wear resistant material consisting essentially of (i) abrasion resistant particles reacted with a bonding material formed during said sintering by a reaction between said abrasion resistant particles and said solid matrix material, and (ii) a contiguous matrix in which said abrasion resistant particles are suspended and to which said abrasion resistant particles are bonded with said bonding material.

2. The method of claim 1 wherein said provided solid matrix material consists essentially of a metal.

3. The method of claim 2 wherein said formed bonding material consists essentially of a metallic carbide, boride, or nitride.

4. The method of claim 3 wherein said provided particles of abrasion resistant particles are of differing size.

5. The method of claim 1 wherein said provided solid matrix consists essentially of a metal alloy containing a metal which is reactive with said provided abrasion resistant particles.

6. The method of claim 1 wherein said wear resistant material is formed directly on a support structure by performing said sintering under the applied pressure.

7. A method for making wear resistant cermet material for use as an abrasion and erosion resistant surface, comprising:

(a) providing abrasion resistant particles;

(b) providing solid matrix material which is reactive with said abrasion resistant particles;

(c) placing a mixture of said abrasion resistant particles and said solid matrix material within a neutral or reducing environment purged of oxygen; and (d) sintering said mixture of said abrasion resistant particles and said solid matrix material in a mold within said neutral or reducing environment purged of oxygen at a sintering temperature at least equal to the liquidus temperature of said solid matrix material and at applied pressure less than about 1,000 psi, thereby forming a wear resistant material consisting essentially of (i) abrasion resistant particles reacted with a bonding material formed during said sintering by a reaction between said abrasion resistant particles and at least one element within said solid matrix material, and (ii) a contiguous matrix in which said abrasion resistant particles are suspended and to which said abrasion resistant particles are bonded with said bonding material.

8. The method of claim 7 wherein said provided solid matrix material is selected from the group of titanium, zirconium, vanadium, chromium, tantalum, molybdenum, niobium, tungsten, gold, silver, palladium, or mixtures thereof.

9. The method of claim 7 wherein said formed bonding material is selected from the group of titanium carbide, titanium boride, titanium nitride, zirconium carbide, zirconium boride, zirconium nitride, or mixtures thereof.

10. The method of claim 7 wherein said provided particles of abrasion resistant particles are selected from the group of boron carbide, aluminum oxide, cubic boron nitride, diamond crystals, or mixtures thereof.

11. The method of claim 7 wherein said provided solid matrix consists essentially of a metal alloy containing a metal which is reactive with said provided abrasion resistant particles.

12. The method of claim 7 wherein said wear resistant cermet material is formed directly on a support structure by placing said mixture in said mold and adjacent to said support structure and performing said sintering under said applied pressure.

13. The method of claim 7 wherein said wear resistant cermet is affixed to a support surface by brazing.

14. The method of claim 7 wherein said wear resistant cermet material is formed directly on a substrate material, and wherein said substrate material has an irregular surface to which said cermet material is bonded thereby increasing the bonding strength of said cermet material to said substrate.

15. The method of claim 7 further comprising forming a stress attenuating layer wherein said stress attenuating layer is formed between said wear resistant cermet material and a substrate to which said wear resistant cermet material is directly bonded thereby altering the stress state of said wear resistant cermet and thereby increasing the fracture toughness of said wear resistant cermet material.

16. A method for making wear resistant cermet material for use as an abrasion and erosion resistant surface, comprising:

(a) providing abrasion resistant particles;

(b) providing solid matrix material which is reactive with said abrasion resistant particles;

(c) placing a mixture of said abrasion resistant particles and said solid matrix material within a neutral or reducing environment purged of oxygen; and (d) sintering said mixture of said abrasion resistant particles and said solid matrix material in a mold within said neutral or reducing environment purged of oxygen at a sintering temperature at least equal to the liquidus temperature of said solid matrix material, thereby forming a wear resistant material consisting essentially of (i) abrasion resistant particles reacted with a bonding material formed during said sintering by a reaction between said abrasion resistant particles and at least one element within said solid matrix material, and (ii) a contiguous matrix in which said abrasion resistant particles are suspended and to which said abrasion resistant particles are bonded with said bonding material, wherein said wear resistant cermet material is formed directly on a support structure by placing said mixture in said mold and adjacent to said support structure and performing said sintering under an applied pressure, and wherein said sintering is performed at a sintering temperature of less than about 1,200 degrees centigrade at a pressure of less than about 1,000 pounds per square inch for a sintering period of less than five minutes.

17. A method for making wear resistant material comprising:

(a) providing abrasion resistant particles;

(b) providing solid matrix material which is reactive with said abrasion resistant particles;

(c) placing a mixture of said abrasion resistant particles and said solid matrix material within a neutral or reducing environment purged of oxygen; and (d) sintering said mixture of said abrasion resistant particles and said solid matrix material within said neutral or reducing environment at a sintering temperature at least equal to the liquidus temperature of said solid matrix material, thereby forming a wear resistant material consisting essentially of (i) abrasion resistant particles reacted with a bonding material formed during said sintering by a reaction between said abrasion resistant particles and said solid matrix material, and (ii) a contiguous matrix in which said abrasion resistant particles are suspended and to which said abrasion, wherein said wear resistant material is formed directly on a support structure by performing said sintering under an applied pressure and wherein said sintering is performed at a sintering temperature of less than about 1200 degrees centigrade at a pressure of less than about 1000 pounds per square inch for a sintering period of less than five minutes.

18. A method for making wear resistant cermet material for use as an abrasion and erosion resistant surface, comprising:

(a) providing abrasion resistant particles;

(b) providing solid matrix material which is reactive with said abrasion resistant particles;

(c) placing a mixture of said abrasion resistant particles and said solid matrix material within a neutral or reducing environment purged of oxygen; and (d) sintering said mixture of said abrasion resistant particles and said solid matrix material in a mold within said neutral or reducing environment purged of oxygen at a sintering temperature at least equal to the liquidus temperature of said solid matrix material, thereby forming a wear resistant material consisting essentially of (i) abrasion resistant particles reacted with a bonding material formed during said sintering by a reaction between said abrasion resistant particles and at least one element within said solid matrix material, and (ii) a contiguous matrix in which said abrasion resistant particles are suspended and to which said abrasion resistant particles are bonded with said bonding material, wherein the surface of said cermet wear resistant material is further processed to enhance abrasion resistant and erosion resistant properties.

19. The method of claim 18 wherein said further processing comprises nitriding or carburizing by bombardment.

20. The method of claim 18 wherein said further processing comprising the application of a film by means of chemical vapor deposition or by means of physical vapor deposition.

21. The method of claim 20 wherein said applied film comprises diamond.

22. A wear resistant cermet material for use as abrasion and erosion resistant surfaces, comprising:

(a) particles of abrasion resistant material;

(b) bonding material which wets and reacts with said particles of abrasion resistant particles;

(c) contiguous matrix material in which said reacted particles of abrasion resistant materials are suspended and bonded; and (d) a surface film to enhance abrasion resistant and erosion resistant properties.

23. The wear resistant cermet material of claim 22 wherein said surface film comprises diamond.

* * * * *